United States Patent [19]

Holt

[11] 4,353,282

[45] Oct. 12, 1982

[54] METHOD AND DEVICE FOR PROJECTILE LUBRICATION

[76] Inventor: Herbert H. Holt, Star Rte., Alpine, Tenn. 38543

[21] Appl. No.: 211,406

[22] Filed: Nov. 28, 1980

[51] Int. Cl.[3] ..... F42B 31/02

[52] U.S. Cl. ..... 86/19; 42/90; 102/511; 184/14

[58] Field of Search ..... 86/19; 42/90; 102/511; 184/14, 15 R

[56] References Cited

U.S. PATENT DOCUMENTS

| | | | |
|---|---|---|---|
| 47,784 | 5/1865 | Ball | 86/19 |
| 476,175 | 5/1892 | Stewart | 86/19 |
| 620,350 | 2/1899 | McGrail | 86/19 |
| 2,535,616 | 12/1950 | Wadman et al. | 86/19 |
| 3,783,972 | 1/1974 | Molstad | 184/15 R |
| 3,942,408 | 3/1976 | Bernath | 86/19 |
| 3,967,526 | 7/1976 | Leich | 86/19 |
| 4,108,044 | 8/1978 | Brown | 86/19 |
| 4,254,572 | 3/1981 | Nelson | 42/90 |

*Primary Examiner*—David H. Brown

*Attorney, Agent, or Firm*—Larry Harold Kline

[57] ABSTRACT

A method and device for placing lubricant in a plurality of annular grooves of a projectile is disclosed comprising placing the projectile into a projectile lubricating device, securing the projectile lubricating device to a reservoir containing lubricant, and activating the flow of lubricant to the projectile through the projectile lubricating device.

6 Claims, 12 Drawing Figures

METHOD AND DEVICE FOR PROJECTILE LUBRICATION

This invention relates to a method and device for lubrication of a projectile and more particularly to a projectile lubricating device which is easily utilized.

In muzzle-loader firearms sports, a projectile known as the Maxi-Ball by the Thompson/Center Arms Company in Rochester, N.H., is of a configuration which has a top band dimension larger than the bore, and center and bottom bands either sized at or slightly smaller than the bore diameter. Two grooves are created which need to be lubricated. The present methods of lubrication primarily are either clumsy, wasteful, messy, or inconvenient to the sportsman.

An object of the present invention is to provide a projectile lubricating device which is not clumsy, wasteful, messy, or inconvenient to the sportsman.

Another object of the present invention is to provide a projectile lubricating device which can be utilized with an ordinary lubricating device.

A further object of the present invention is to provide a projectile lubricating device which places lubricant in the desired areas on the projectile without the lubricant being placed on other portions of the projectile.

Still another object of the present invention is to provide an easy method for placing lubricant in the annular grooves of a projectile utilizing a projectile lubricating device secured to flow means.

A further object of the present invention is to provide a projectile lubricating device which is easy and convenient to the sportsman, simplifying the lubricating chore and leaving more time for concern with the safety aspects of the sport.

Still another object of the present invention is to provide a projectile lubricating device in which the projectile can be inserted from either side of the device for equal easy access by right or left-handed persons.

A further object of the present invention is to provide a projectile lubricating device which is small and portable and can be carried easily and conveniently by the sportsman.

Another object of the present invention is to provide a projectile lubricating device which has a method of indicating to the sportsman when the lubrication process is completed.

These and other objects and features of the invention will be apparent from the following description and appended claims.

Briefly, the invention is a method and device for placing lubricant in a plurality of annular grooves of a projectile. The device comprises a structure containing an opening dimensioned to hold the projectile. Passage in the structure extends through the exterior wall of the structure creating an interior opening and an exterior opening. The passage is positioned to enter the structure so that the interior opening of the passage is positioned at the depth of the structure where the plurality of annular grooves of the projectile are held. A connector is secured to the structure at the exterior opening of the passage. A connector passage within the connector is aligned with the exterior opening of the passage. Lubricant may pass through the connector passage to the passage and into the plurality of annular grooves of the projectile. Flow means containing the lubricant is connected to the connector and is operative, when activated, to dispense the lubricant through the connector passage and the passage to the plurality of conical grooves of the projectile. The projectile comprises a nose section with a bearing portion. The bearing portion is dimensioned larger than the diameter of the opening of the structure. When the projectile is held in the structure, the bearing portion rests on an external bearing surface of the structure thereby sealing the top of the opening of the structure. The projectile further comprises a base section dimensioned slightly smaller than the diameter of the opening of the structure. The base of the projectile may be placed into the opening easily. Lubricant may exude between the base section and the structure when the plurality of annular grooves of the projectile has been filled with the lubricant. This exutation indicates that the projectile is fully lubricated. The projectile further comprises a middle ridge around the projectile between the bearing portion and the base section. A first annular groove is formed between the bearing portion and the middle ridge. A second annular groove is formed between the base section and the middle ridge. The middle ridge is dimensioned slightly smaller than the diameter of the opening in the structure. Instead of having one passage extending through the exterior wall of the structure to deliver lubricant to the plurality of annular grooves, a plurality of passages may be utilized. A first passage in the structure may extend through an exterior wall of the structure creating a first interior opening and a first exterior opening. A first passage is positioned to enter the structure so that the first interior opening of the first passage is positioned at the depth of the structure where one of said plurality of annular grooves is held. A second passage in the structure extends through the same exterior wall of the structure creating a second interior opening and a second exterior opening. The second passage is positioned to enter the structure so that the second interior opening of the passage is positioned at the depth of the structure where a second of said plurality of conical grooves of the projectile is held. The connector is secured to the structure encompassing the first exterior opening and the second exterior opening. The connector passage within the connector is aligned with the first exterior opening and the second exterior opening whereby the lubricant may pass through the connector passage to the first passage and the second passage and into the plurality of annular grooves of the projectile. The lubricant may pass from the first passage into the first annular groove and from the second passage into the second annular groove. The method for placing lubricant in a plurality of annular grooves of a projectile comprises securing a projectile lubricating device to a reservoir containing lubricant. The projectile is placed into the projectile lubricating device. Flow means is activated to move the lubricant from the reservoir through the projectile lubricating device to the plurality of annular grooves of the projectile.

The invention will be more fully understood from the following detailed description and appended claims when taken with the drawings in which:

FIG. 1 is an isometric view of projectile lubricating device 1 utilizing a single passage 5.

FIG. 2 is an isometric view of projectile lubricating device 1 utilizing two passages, upper lubricant passage 8 and lower lubricant passage 9.

Figure 5:
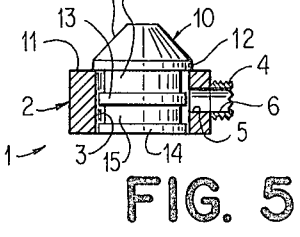

FIG. 5 is a sectional view of projectile lubricating device 1 utilizing the single lubricant passage 5 with projectile 10 inserted.

Figure 6:
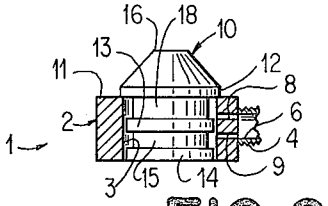

FIG. 6 is a sectional view of projectile lubricating device 1 utilizing upper lubricant passage 8 and lower lubricant passage 9 with projectile 10 inserted.

Figure 7:
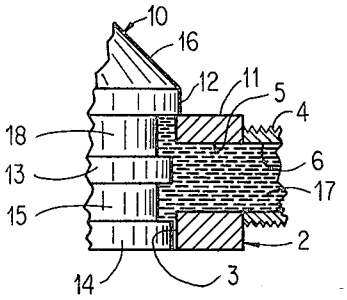

FIG. 7 is a partial sectional view showing the flow pattern of lubricant 17 in a projectile lubricating device 1 utilizing the single lubricant passage 5.

Figure 8:
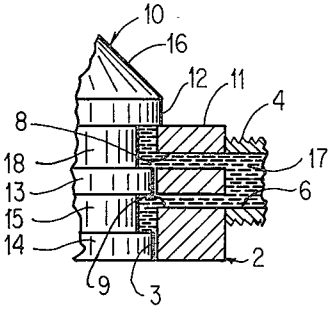

FIG. 8 is a partial sectional view showing the flow pattern of lubricant 17 in a projectile lubricating device 1 utilizing the upper lubricant passage 8 and lower lubricant passage 9.

Figure 9:
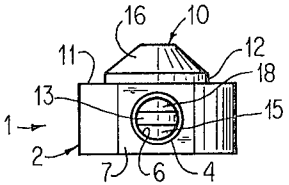

FIG. 9 is an elevational view of projectile lubricating device 1 with the lubricant passage 6 centered showing the relationship of the middle ridge 13 of projectile 10 to the lubricant passage 6 and lubricant passage 5.

Figure 10:
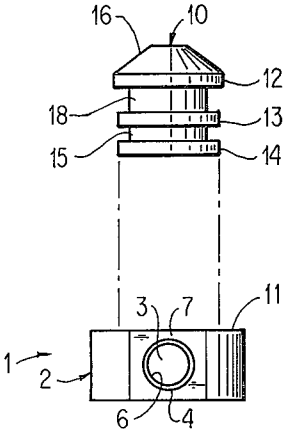

FIG. 10 is an exploded elevational view of projectile 10 in relationship with projectile lubricating device 1.

Figure 11:
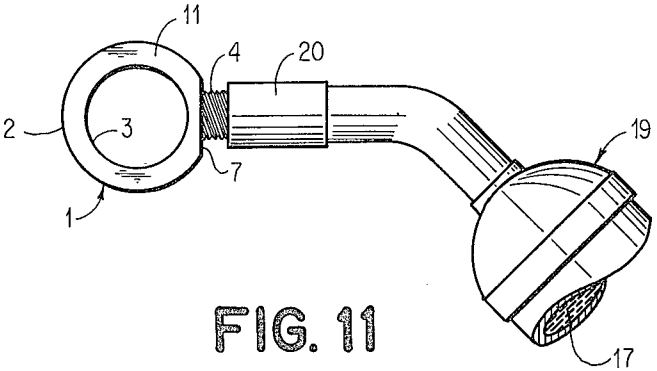

FIG. 11 is an elevational view of projectile lubricating device 1 secured to a lubricating device 19.

Figure 12:
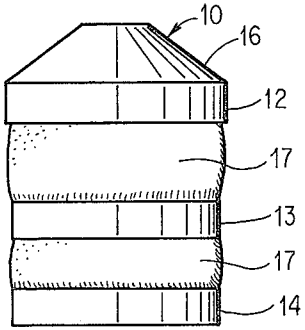

FIG. 12 is an elevational view of a projectile 10 after being lubricated and removed from projectile lubricating device 1.

Figure 1:
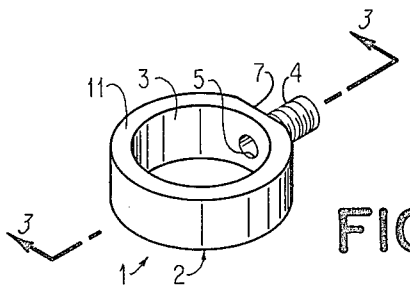

Referring now to the drawings, FIG. 1 is an isometric view of projectile lubricating device 1 utilizing a single passage 5. Projectile lubricating device 1 has body 2. Body 2 has a projectile receiving opening 3. Projectile lubricating device 1 may have a single lubricant passage 5 which is connected to a threaded connector 4.

Figure 2:
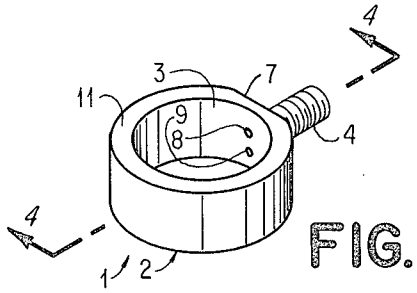

FIG. 2 is an isometric view of projectile lubricating device 1 utilizing two passages, upper lubricant passage 8 and lower lubricant passage 9. Both upper lubricating passage 8 and lower lubricant passage 9 would be open to lubricant passage 6 within threaded connector 4.

Figure 3:
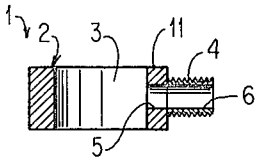
FIG. 3 is a sectional view taken at section 3—3 of FIG. 1.

FIG. 3 is a sectional view taken at section 3—3 of FIG. 1. Lubricant passage 6 in threaded connector 4 is open to lubricant passage 5 in body 2.

Figure 4:
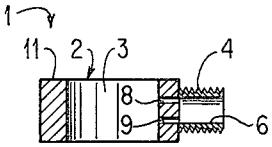
FIG. 4 is a sectional view taken at section 4—4 of FIG. 2.

FIG. 4 is a sectional view taken at section 4—4 of FIG. 2. Upper lubricant passage 8 and lower lubricant passage 9 in body 2 are open to lubricant passage 6 in threaded connector 4.

FIG. 5 is a sectional view of projectile lubricating device 1 utilizing the single lubricant passage 5 with projectile 10 inserted. Projectile 10 has bearing portion 12. Bearing portion 12 is located on nose section 16 of projectile 10. Projectile 10 has a middle ridge 13 and base 14. Between bearing portion 12 and middle ridge 13 is upper lubricant receiving channel 18. Between middle ridge 13 and base 14 of projectile 10 is lower lubricant receiving channel 15. Lubricant passage 5 in body 2 is open to upper lubricant receiving channel 18 and lower lubricant receiving channel 15.

FIG. 6 is a sectional view of projectile lubricating device 1 utilizing upper lubricant passage 8 and lower lubricant passage 9 with projectile 10 inserted. Upper lubricant passage 8 is open to upper lubricant receiving channel 18. Lower lubricant passage 9 is open to lower lubricant receiving channel 15.

FIG. 7 is a partial sectional view showing the flow pattern of lubricant 17 in projectile lubricating device 1 utilizing the single lubricant passage 5. Lubricant 17 passes through lubricant passage 6 in threaded connector 4 and then through lubricant passage 5 in body 2. The lubricant 17 completely surrounds the upper lubricant receiving channel 18 and lower lubricant receiving channel 15 of projectile 10. Excess lubricant 17 cannot flow out of the top of projectile lubricating device 1 because of the tight seal between the bearing portion 12 of nose section 16 of projectile 10 and bearing surface 11 of body 2. Bearing portion 12 is of slightly larger diameter than the diameter of the projectile receiving opening 3. Middle ridge 13 and base 14 of projectile 10 are of slightly smaller diameter than the projectile receiving opening 3 of projectile lubricating device 1. When the space between the upper lubricant receiving channel 18 and body 2 and between lower lubricant receiving channel 15 and body 2 is filled with lubricant 17, a small amount of lubricant 17 may escape the base 14 of projectile 10 and the body 2 of projectile lubricating device 1. The escape of this small amount of lubricant 17 indicates to the user of projectile lubricating device 1 that the lubricating function has been completed.

FIG. 8 is a partial sectional view showing the flow pattern of lubricant 17 in projectile lubricating device 1 utilizing upper lubricant passage 8 and lower lubricant passage 9. Lubricant 17 flows through lubricant passage 6 in threaded connector 4 and then through upper lubricant passage 8 and lower lubricant passage 9 in body 2. The lubricant 17 passing through upper lubricant passage 8 in body 2 forms a coating of lubricant 17 around upper lubricant receiving channel 18. The lubricant 17 passing through lower lubricant passage 9 in body 2 forms a coating of lubricant 17 around lower lubricant receiving channel 15. Lubricant 17 may escape between the base 14 of projectile 10 and body 2 to indicate the completion of the lubricating function. Base 14 is of a slightly smaller diameter than the projectile receiving opening 3 of body 2.

FIG. 9 is an elevational view of projectile lubricating device 1 centered on lubricant passage 6 of threaded connector 4. FIG. 9 shows the relationship of middle ridge 13 of projectile 10 to the lubricant passage 6 of threaded connector 4. The location of the lubricant passage 6 and either lubricant passages 8 and 9 in body 2 in such that the lubricant 17 will easily flow to both the upper lubricant receiving channel 18 and lower lubricant receiving channel 15 of projectile 10.

FIG. 10 is an exploded elevational view of projectile 10 in relationship with projectile lubricating device 1. Projectile 10 may be inserted from either side of projectile lubricating device 1. The middle ridge 13 and base 14 of projectile 10 will pass through projectile receiving opening 3 of body 2. The projectile 10 will then rest in the projectile lubricating device 1. Bearing portion 12 of nose section 16 of projectile 10 is of a larger diameter than the projectile receiving opening 3 of body 2. Bearing portion 12 will rest upon bearing surface 11 of body 2.

FIG. 11 is an elevational view of projectile lubricating device 1 secured to a lubricating device 19. Lubricating device 19 may be of a hand-held or very small variety. Lubricating device 19 will contain lubricant 17 and some form of device which causes lubricant 17 to flow through lubricating device 19 and through the connecting section 20 of lubricating device 19 and the lubricant passage 6 in threaded connector 4. Threaded connector 4 may be threaded or screwed into the connecting section 20 of lubricating device 19. The connecting section 20 of lubricating device 19 may be screwed onto threaded connector 4 toward flattened portion 7 of body 2. The flattened portion 7 of body 2 may be flattened or of any desired shape to perform the functions of the projectile lubricating device 1.

FIG. 12 is an elevational view of projectile 10 after being lubricated and removed from projectile lubricating device 1. Projectile 10 will have a coating of lubricant 17 between the bearing portion 12 and middle ridge 13 and the middle ridge 13 and base 14 of projectile 10.

The projectile 10 will be of a design known as the Maxi-Ball by Thompson/Center Arms Company of Rochester, N.H. The projectile lubricating device 1 may be made of any dimension which corresponds with the appropriate dimensions of the caliber Maxi-Ball desired. The Maxi-Ball and bullets of the same configuration by other companies have a top band dimension or bearing portion 12 which is several Thousandths of an inch larger than the bore diameter. The center and bottom bands, middle ridge 13 and base 14, are sized at, or approximately a Thousandths of an inch below bore diameter. In use in a muzzle-loader firearm, as the powder charge ignites, the bullet's base is forced down the bore. The base 14 begins to move before the bullet's nose section 16. This situation compresses the bullet's overall length causing the soft lead to spread out. The grooves, upper lubricant receiving channel 18 and lower lubricant receiving channel 15, are filled with the soft lead spreading out. The lubricant 17 which has coated the upper lubricant receiving channel 18 and the lower lubricant receiving channel 15 then provides proper lubrication for the projectile 10 to be fired from the muzzle-loader firearm.

This invention provides a projectile lubricating device which can be utilized with an ordinary lubricating device. This projectile lubricating device will place the lubricant in the desired areas on the projectile without the lubricant being placed on other portions of the projectile. Since the lubricant is placed only on the areas of the projectile desired, the projectile lubricating device is not clumsy, wasteful, messy or inconvenient to the sportsman using the projectile lubricating device. This device simplifies the lubricating chore and leaves the sportsman more time for concern with the safety aspects of the sport. The projectile can be inserted from either side of the projectile lubricating device for equal easy access by right or left-handed persons. The projectile lubricating device is small and portable and can be easily carried by the sportsman.

The invention also provides a projectile lubricating device which has a method for placing the lubricant in the conical grooves of a projectile when the projectile lubricating device is secured to flow means. A further method is provided by the projectile lubricating device which indicates to the sportsman when the lubrication process is completed.

The present invention satisfies a need in the field of muzzle-loader firearms sports. Utilizing muzzle-loader firearms, it is important to lubricant each projectile utilized. The sportsman may conveniently lubricate the projectiles in volume prior to shooting in volume or the projectiles may be easily lubricated one at a time in the field. When utilizing the projectile lubricating device, the sportsman does not have to dip his hand into the lubricant, which can be messy. Also the projectile lubricating device will aid the sportsman in that he will not be applying grease or lubricant to undesired areas on the projectile and will not be applying more grease or lubricant than is necessary for proper lubrication of the projectile. If the bullet or projectile 10 is slicker than preferred, it could possibly be easily dropped on the ground. With confidence in the lubrication of the projectile, the sportsman has more time to concern himself with safety. Slick lubrication in the wrong place will not be the cause of sportsman's accidents when utilizing the projectile lubricating device 1.

The projectile or bullet 10 can be inserted in the projectile lubricating device 1 from either side. Either way, the bearing portion 12 will rest on bearing surface 11 of body 2. The bearing surface 11 on the top of body 2 is identical to the bearing surface 11 on the bottom of body 2. The bullet or projectile 10 will not fall through the projectile receiving opening 3 in body 2 because the bearing portion 12 of projectile or bullet 10 is of a larger diameter than the projectile receiving opening 3. The bullet or projectile 10 is, therefore, easily held within projectile lubricating device 1 and easily lubricated when the projectile lubricating device 1 is secured to lubricating device 19. The lubricating device 19 may be a small, hand-held lubricating gun which is readily available.

Any type of grease or lubricant commonly available can be utilized. Crisco, which is a popular lubricant for muzzle-loader firearms, may be easily utilized. The lubricant is placed exactly where it is needed. Other bullet areas, such as the base section 14 which should be clean when it is loaded, do not run the risk of messy lubricant being placed upon it. If the lubricant contacts the powder charge, the combustion may be reduced to a small degree and the efficiency of the muzzle-loader firearm reduced.

Threaded connector 4 of projectile or bullet 10 may be threaded or may be secured to the lubricating device 19 in some other manner. If the securing means does not require threads, then connector 4 may be any connector desired to perform the function of connecting the projectile lubricating device to the lubricating device 19.

The projectile lubricating device 1 performs the operation of placing lubricant in the grooves of conically grooved bullets, such as the Thompson/Center Arms Company Maxi-Ball, and bullets of the same configuration by other companies. A mere push or two on the lever of a grease gun, such as lubricating device 19, accomplishes the lubrication process.

The grooved areas, upper lubricant receiving channel 18 and lower lubricant receiving channel 15, of projectile or bullet 10 are completely enclosed in projectile lubricating device 1 with an open channel from the grease gun reservoir to the grooves of the bullet. All other areas of the bullet or projectile 10 are sealed off from the grease flow.

When the bullet grooves 15 and 18 are fully packed, a minute amount of lubricant will exude from the space between the bullet base section 14 and the bore or projectile receiving opening 3 of projectile lubricating device 1. This minute amount of lubricant indicates to the sportsman that the bullet 10 is now fully lubricated and ready for removal. The nose section 16 of bullet 10 at bearing portion 12 forms a seal against the bearing surface 11 to prevent leakage or overflow of the lubricant 17 through the nose section 16.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for placing lubricant in a plurality of annular grooves of a projectile comprising:

a. a structure containing an opening dimensioned to hold said projectile;

b. a passage in said structure extending through an exterior wall of said structure creating an interior opening and an exterior opening, said passage positioned to enter said structure so that said interior opening of said passage is positioned at the depth of said structure where said plurality of annular grooves of said projectile are held;

c. a connector secured to said structure at said exterior opening of said passage;

d. a connector passage within said connector and aligned with said exterior opening of said passage, and e. said projectile comprising a nose section with a bearing portion dimensioned larger than the diameter of said opening in said structure whereby when said projectile is held in said structure, said bearing portion will rest on an external bearing surface of said structure sealing the top of said opening in said structure, whereby said lubricant may pass through said connector passage to said passage and into said plurality of annular grooves of said projectile.

2. A device according to claim 1 wherein said projectile further comprises a base section dimensioned slightly smaller than the diameter of said opening in said structure whereby the base of said projectile may be placed into said opening and said lubricant may exude between said base section and said structure when said plurality of annular grooves of said projectile have been filled with said lubricant, thereby indicating that said projectile is fully lubricated.

3. A device according to claim 2 wherein said projectile further comprises a middle ridge around said projectile between said bearing portion and said base section forming a first annular groove between said bearing portion and said middle ridge and a second annular groove between said base section and said middle ridge, said middle ridge dimensioned slightly smaller than said diameter of said opening in said structure.

4. A device for placing lubricant in a plurality of annular grooves of a projectile comprising:

a. a structure containing an opening dimensioned to hold said projectile;

b. a first passage in said structure extending through an exterior wall of said structure creating a first interior opening and a first exterior opening, said first passage positioned to enter said structure so that said first interior opening of said first passage is positioned at the depth of said structure where one of said plurality of annular grooves of said projectile is held;

c. a second passage in said structure extending through said exterior wall of said structure creating a second interior opening and a second exterior opening, said second passage positioned to enter said structure so that said second interior opening of said passage is positioned at the depth of said structure where a second of said plurality of annular grooves of said projectile is held;

d. a connector secured to said structure encompassing said first exterior opening and said second exterior opening of said passage;

e. a connector passage within said connector and aligned with said first exterior opening and said second exterior opening of said passage; and f. said projectile comprising a nose section with a bearing portion dimensioned larger than the diameter of said opening in said structure whereby when said projectile is held in said structure, said bearing portion will rest on an external bearing surface of said structure sealing the top of said opening in said structure, whereby said lubricant may pass through said connector passage to said first passage and said second passage and into said plurality of annular grooves of said projectile.

5. A device according to claim 4 wherein said projectile further comprises a base section dimensioned slightly smaller than the diameter of said opening in said structure whereby the base of said projectile may be placed into said opening and said lubricant may exude between said base section and said structure when said plurality of annular grooves of said projectile have been filled with said lubricant, thereby indicating that said projectile is fully lubricated.

6. A device according to claim 5 wherein said projectile further comprises a middle ridge around said projectile between said bearing portion and said base section forming a first annular groove between said bearing portion and said middle ridge and a second annular groove between said base section and said middle ridge, said middle ridge dimensioned slightly smaller than said diameter of said opening in said structure, whereby said lubricant may pass from said first passage into said first annular groove and from said second passage into said second annular groove.

* * * * *